US010376951B2

(12) United States Patent
Takahashi

(10) Patent No.: US 10,376,951 B2
(45) Date of Patent: Aug. 13, 2019

(54) METHOD OF MANUFACTURING CONDUCTIVE METAL SHEET AND APPARATUS FOR MANUFACTURING CONDUCTIVE METAL SHEET

(71) Applicant: Kenzo Takahashi, Matsudo (JP)

(72) Inventor: Kenzo Takahashi, Matsudo (JP)

( * ) Notice: Subject to any disclaimer, the term of this patent is extended or adjusted under 35 U.S.C. 154(b) by 96 days.

(21) Appl. No.: 15/539,749

(22) PCT Filed: Dec. 15, 2015

(86) PCT No.: PCT/JP2015/085044
§ 371 (c)(1),
(2) Date: Jun. 26, 2017

(87) PCT Pub. No.: WO2016/104244
PCT Pub. Date: Jun. 30, 2016

(65) Prior Publication Data

US 2017/0368598 A1 Dec. 28, 2017

(30) Foreign Application Priority Data

Dec. 26, 2014 (JP) ..... 2014-265822

(51) Int. Cl.
*B22D 11/115* (2006.01)
*B22D 11/06* (2006.01)
*B22D 11/112* (2006.01)

(52) U.S. Cl.
CPC ..... *B22D 11/115* (2013.01); *B22D 11/0605* (2013.01); *B22D 11/112* (2013.01)

(58) Field of Classification Search
CPC ... B22D 11/045; B22D 11/112; B22D 11/114; B22D 11/115; B22D 11/124;
(Continued)

(56) References Cited

U.S. PATENT DOCUMENTS

2002/0060061 A1 5/2002 Lee et al.
2014/0069602 A1 3/2014 Takahashi

FOREIGN PATENT DOCUMENTS

JP 6-71303 A 3/1994
JP 6-71304 A 3/1994
(Continued)

OTHER PUBLICATIONS

International Search Report dated Feb. 16, 2016 in PCT/JP2015/085044 filed Dec. 15, 2015.
(Continued)

*Primary Examiner* — Kevin P Kerns
*Assistant Examiner* — Steven S Ha
(74) *Attorney, Agent, or Firm* — Oblon, McClelland, Maier & Neustadt, L.L.P.

(57) ABSTRACT

[Object] There are provided a manufacturing method and a manufacturing apparatus that obtain a high-quality conductive metal sheet in a short time.
[Solution] The invention includes: applying a magnetic field to the raw material or the pre-product in a thickness direction by a magnetic field unit including permanent magnets; making alternating current flow in at least one of the raw material and molten metal of the pre-product so that the alternating current intersects the magnetic field in at least the front and the rear of a lengthwise direction of the magnetic field unit; and applying vibration to at least one of the raw material and the molten metal of the pre-product by an electromagnetic force generated due to the intersection to modify the molten metal and form the conductive metal sheet in which all of the molten metal is solidified.

5 Claims, 3 Drawing Sheets

(58) Field of Classification Search
CPC . B22D 11/1243; B22D 11/1246; B22D 11/22; B22D 11/225
See application file for complete search history.

(56) References Cited

FOREIGN PATENT DOCUMENTS

| | | | | |
|---|---|---|---|---|
| JP | 7-11402 | A | 1/1995 | |
| JP | 2002-153957 | A | 5/2002 | |
| JP | 2013-103229 | A | 5/2013 | |
| WO | WO-2013069314 | A1 * | 5/2013 | ..... B22D 11/041 |

OTHER PUBLICATIONS

Extended European Search Report dated Nov. 15, 2017 in Patent Application No. 15872813.9.

* cited by examiner

METHOD OF MANUFACTURING CONDUCTIVE METAL SHEET AND APPARATUS FOR MANUFACTURING CONDUCTIVE METAL SHEET

TECHNICAL FIELD

The present invention relates to a method of manufacturing a conductive metal sheet and an apparatus for manufacturing a conductive metal sheet.

BACKGROUND ART

There have been methods disclosed in, for example, Patent Literature 1 and the like as a method of manufacturing an aluminum alloy sheet. The methods disclosed in Patent Literature 1 and the like are methods of manufacturing an aluminum sheet material that include a step of performing the hot rolling of an aluminum alloy sheet material and performing annealing and solution heat treatment without performing substantially intermediate cooling and rapid cooling.

CITATION LIST

Patent Literature

Patent Literature 1: JP 6-71303 A
Patent Literature 2: JP 6-71304 A
Patent Literature 3: JP 7-11402 A

SUMMARY OF INVENTION

Technical Problem

The methods disclosed in Patent Literature 1 and the like are methods that can obtain an aluminum alloy sheet without requiring so-called separate batch treatment. However, since the present inventor has had an object unique to the invention that is to provide a conductive metal sheet having quality higher than that in the related art in a short time, the invention has been made to achieve the object unique to the present inventor and is to provide a method of manufacturing a conductive metal sheet and an apparatus for manufacturing a conductive metal sheet.

Solution to Problem

A method of manufacturing a conductive metal sheet according to an embodiment of the invention is a method of manufacturing a conductive metal sheet, the method comprises cooling and solidifying molten conductive metal flowing out of a melting furnace by a cooling device to form a conductive metal sheet, cooling a raw material in which all of the conductive metal is in a molten state to make the raw material become a pre-product of which a part is solidified and the rest is in a molten state, and cooling further the pre-product to make the pre-product become the conductive metal sheet as a product in which all of the molten metal is solidified, the method comprising:

applying a magnetic field to the raw material or the pre-product in a thickness direction by a magnetic field unit including permanent magnets;

making alternating current flow at least between the front position and the rear position of a lengthwise direction of the magnetic field unite, and making the alternating current flow at least one of the raw material and molten metal of the pre-product, so that the alternating current intersects the magnetic field; and applying vibration to at least one of the raw material and the molten metal of the pre-product by an electromagnetic force generated due to the intersection to modify the molten metal and form the conductive metal sheet in which all of the molten metal is solidified.

An apparatus for manufacturing a conductive metal sheet according to an embodiment of the invention is an apparatus for manufacturing a conductive metal sheet, the apparatus comprises a cooling device for cooling and solidifying molten conductive metal flowing out of a melting furnace to form a conductive metal sheet, for cooling a raw material in which all of the conductive metal is in a molten state to make the raw material become a pre-product of which a part is solidified and the rest is in a molten state, and for cooling further the pre-product to make the pre-product become the conductive metal sheet as a product in which all of the molten metal is solidified, the apparatus comprising:

a magnetic field unit that applies a magnetic field to the raw material or the pre-product in a thickness direction and includes permanent magnets; and a first electrode and a second electrode that make alternating current, which intersects the magnetic field and generates an electromagnetic force vibrating and modifying the molten metal, flow in at least one of the raw material and the pre-product.

DESCRIPTION OF EMBODIMENTS

Figure 1:
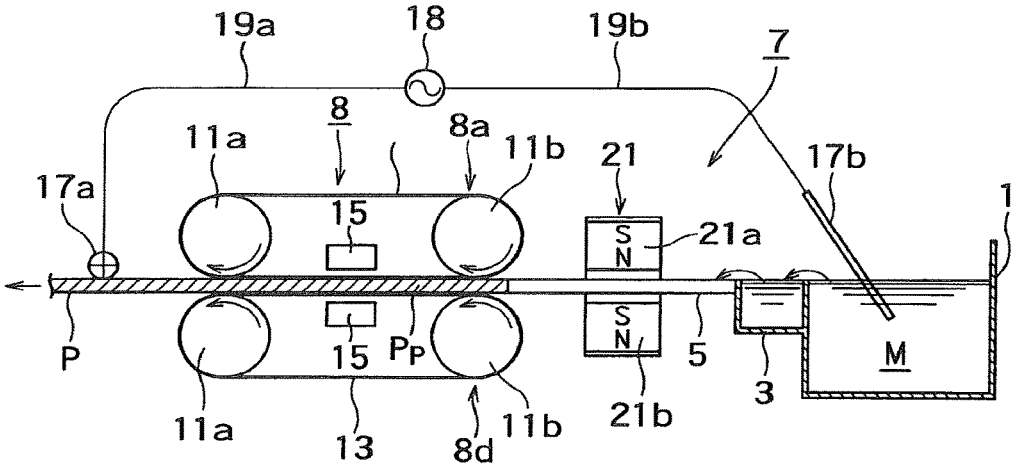
FIG. 1 is a schematic diagram illustrating main parts of an apparatus for manufacturing a conductive metal sheet according to a first embodiment of the invention.

FIG. 1 is a schematic diagram illustrating main parts of an apparatus for manufacturing a conductive metal sheet according to a first embodiment of the invention. As known from FIG. 1, this apparatus refines crystal grains of molten conductive metal M, which is present in a melting furnace 1, by an electromagnetic force to modify the molten conductive metal M, pulls the conductive metal M from an output side by moderate tension, and sends the conductive metal M to the next stage as a high-quality product (conductive metal sheet) P. The conductive metal is conductive metal, such as non-ferrous metal (conductors (conductive bodies), such as, Al, Cu, Zn, an alloy of at least two of these, or a Mg alloy)) or ferrous metal. As publicly known, the product P becomes a conductive metal sheet as a thinner and higher-quality finished product by being further subjected to various kinds of treatment. In this sense, a conductive metal sheet obtained in the invention should be referred to as a material for a conductive metal sheet, but is simply called a conductive metal sheet here.

In more detail, the apparatus for manufacturing a conductive metal sheet includes the melting furnace 1 that stores the molten conductive metal M. A reservoir 3 as a purifier, which performs degassing and filtration, is provided on the next stage of the melting furnace 1. A flow channel 5 as a trough, which allows the molten metal M to flow, is provided on the outlet side of the reservoir 3. In the flow channel 5, the conductive metal is in a liquid state, that is, the state of the molten metal M. A magnetic field unit 21 as a part of a quality improvement device 7, which improves the quality of the molten metal M by vibrating (rotating) the molten metal M as described below, is provided on the flow channel 5.

A cooling device 8, which cools the molten metal M to form a conductive metal sheet, is provided on the outlet side of the flow channel 5. That is, as publicly known, a long mold frame body (not illustrated), into which the molten metal M flows and which determines a width and a thickness, is connected to the outlet side of the flow channel 5 and the cooling device 8 is provided on the upper and lower sides of the mold frame body. The molten metal M is gradually solidified by the cooling device 8, but the solidification rate of the molten metal M depends on the pulling speed of the conductive metal sheet. That is, for example, if the pulling speed is low, the molten metal M is completely solidified and becomes a product P (that is, a product P which is solidified up to the inside of a sheet) when coming out from front pulleys 11*a* to be described below. If the pulling speed is high, the molten metal M becomes a pre-product Pp of which only the surface of is solidified and the inside is in the state of the molten metal M when coming out from the front pulleys 11*a*.

In more detail, the cooling device 8 includes an upper cooling device 8*a* and a lower cooling device 8*d*, and the upper and lower cooling devices 8*u* and 8*d* have substantially the same structure. Accordingly, the upper cooling device 8*u* will be described first. A belt 13 for cooling is stretched between a pair of pulleys 11*a* and 11*b*. At least one of the pulleys 11*a* and 11*b* is rotationally driven, so that the belt 13 is rotated clockwise in FIG. 1. The belt 13 is made of a stable material (stainless steel, copper, or the like) that does not react to conductive metal as the material of the product P or the like, and a so-called steel belt can be used as the belt 13. Since the belt 13 comes into contact with the product P or the like on the lower side in FIG. 1 as also known from FIG. 1, the belt 13 can cool the product P or the like. A cooling device body 15, which cools the belt 13, is provided near the belt 13. The cooling device body 15 has only to cool the belt 13, and the structure of the cooling device body 15 is not particularly limited. For example, the cooling device body 15 can employ a structure that sprays cooling liquid on the belt 13, or the like. Further, a water jacket as a so-called water-cooling device in which water flows can also be used as the cooling device body 15. Accordingly, the cooled belt 13 cools the product P or the like. Therefore, a solidified product P is obtained, and is sent to the next stage. The upper cooling device 8*u* illustrated in FIG. 1 has been described above, but the detailed description of the lower cooling device 8*d* will be omitted since the lower cooling device 8*d* is the same as the upper cooling device 8*u*.

Further, a downstream electrode 17*a* electrically connected to the product P having come out from the cooling device 8 and an upstream electrode 17*b* electrically connected to the molten metal M present in the melting furnace 1 are provided. These electrodes 17*a* and 17*b* form a part of the quality improvement device 7. These electrodes 17*a* and 17*b* are connected to a power source 18 by wires 19*a* and 19*b*. The power source 18 is formed of a power source that can make alternating current and direct current flow between the electrodes 17*a* and 17*b* and adjust polarity reversal, a voltage, current, and a frequency.

Current I can be made to flow between the electrodes 17*a* and 17*b* by the power source 18. That is, a current path, which is formed in the order of the power source 18, the wire 19*a*, the electrode 17*a*, the product P, the molten metal M present in the flow channel 5, the molten metal M present in the reservoir 3, the molten metal M present in the melting furnace 1, the wire 19*b*, and the power source 18, is formed; and alternating current can be made to flow in the current path at, for example, a frequency set by the power source 18. The magnetic field unit 21 of the quality improvement device 7 is provided on the current path. That is, the magnetic field unit 21 includes permanent magnets 21*a* and 21*b* that are disposed on the upper and lower sides in FIG. 1 with the flow channel 5 interposed therebetween as known from FIG. 1. In FIG. 1, magnetic lines ML of force extend downward from the upper side in FIG. 1. Since the flow channel 5 is thinner than a slab, a billet, or the like, so-called magnetic field efficiency is very high. Accordingly, even though the intensity of a magnetic field generated from the magnetic field unit 21 is low, the improvement of quality, such as the refinement of crystal grains, is performed with high efficiency.

Further, since current I (I1(*a*) and I2(*b*)) flows in the molten metal M present in the flow channel 5 in a horizontal direction of FIG. 1 and magnetic lines ML of force extend vertically, an electromagnetic force according to Fleming's law acts on the molten metal M. For example, when the current I is alternating current, the molten metal M is driven so as to vibrate. As a result, the quality of the molten metal M is improved, that is, crystal grains are refined and are made uniform.

Figure 3:
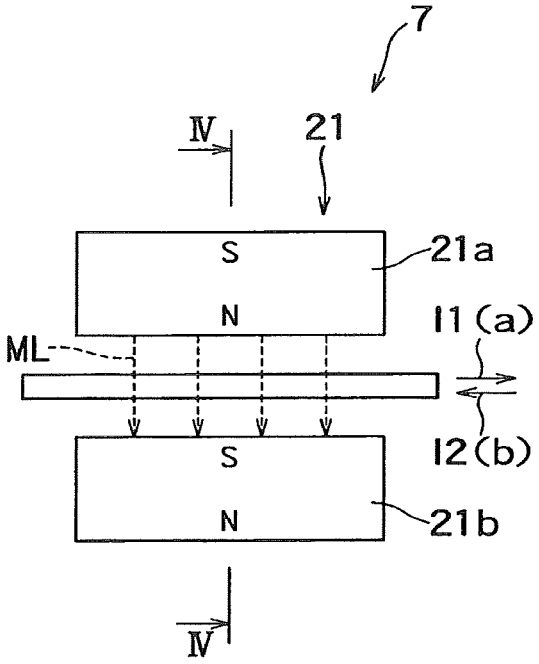
FIG. 3 is a diagram selectively illustrating a part of FIG. 1 and illustrating a relationship between current and a magnetic field applied to a conductive metal sheet.
Figure 4A:
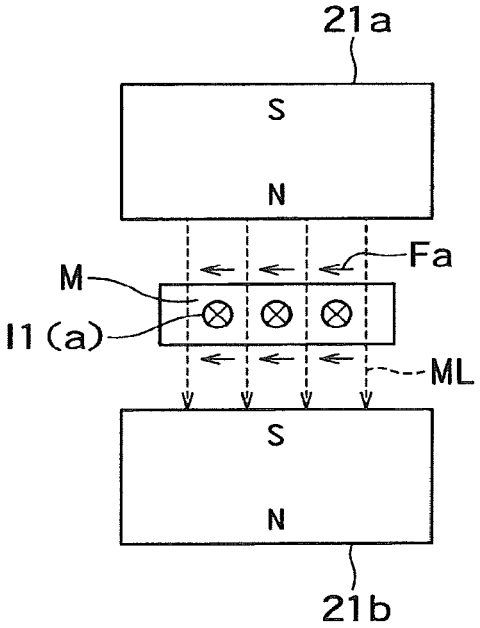
FIG. 4(A) is a diagram illustrating a cross-section taken along line IV-IV of FIG. 3 and illustrating a relationship between a magnetic field, current, and an electromagnetic force.
Figure 4B:
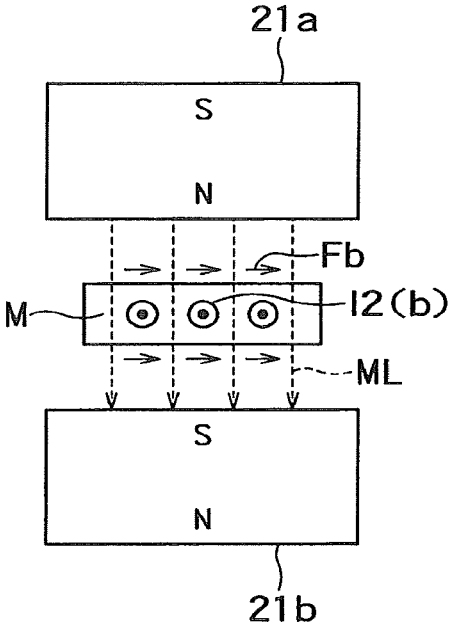
FIG. 4(B) is another diagram illustrating a cross-section taken along line IV-IV of FIG. 3 and illustrating a relationship between a magnetic field, current, and an electromagnetic force.

FIG. 3 and FIGS. 4(A) and 4(B) illustrate the aspects of current I (I1(*a*) and I2(*b*)), magnetic lines ML of force, and electromagnetic forces Fa and Fb at the time of the improvement of quality. FIG. 3 illustrates a part of FIG. 1, and FIGS. 4(*a*) and 4(*b*) are diagrams illustrating a cross-section taken along line IV-IV of FIG. 3. FIG. 4(A) illustrates an electromagnetic force Fa acting on the molten metal M when current I1(*a*) flows to the right in FIG. 3, and FIG. 4(B) illustrates an electromagnetic force Fb acting on the molten metal M when current I2(*b*) flows to the left. The electromagnetic forces Fa and Fb alternately act on the molten metal M in accordance with the period of the power source 18 (5 Hz or 30 Hz), so that the molten metal M vibrates and the quality of the molten metal M is improved. Although briefly described above, not only the intensity of a magnetic field generated by the magnetic field unit 21 but also flowing current I may be small since the molten metal M as a target is thin. Accordingly, the current consumption of this embodiment can be made very small.

That is, in the apparatus for manufacturing a conductive metal sheet, the molten metal M becomes a product P in a solid state by flowing through the melting furnace 1, the reservoir 3, the flow channel 5, and the cooling device 8 although also briefly described above. Even though all of the molten metal M is in a liquid state or the outer periphery of the molten metal M is solidified and only the inside of the molten metal M is in a liquid state in the flow channel 5, the molten metal M is vibrated by the electromagnetic forces Fa and Fb that are generated by magnetic lines ML of force generated from the magnetic field unit 21 and the current I flowing between the electrodes 17*a* and 17*b*. Accordingly, the molten metal M is modified. That is, for the purpose of the improvement of the quality of the molten metal M, the magnetic lines ML of force and a magnetic field have only to be applied to the molten metal M at any position where the molten metal M is not yet solidified.

Figure 2:
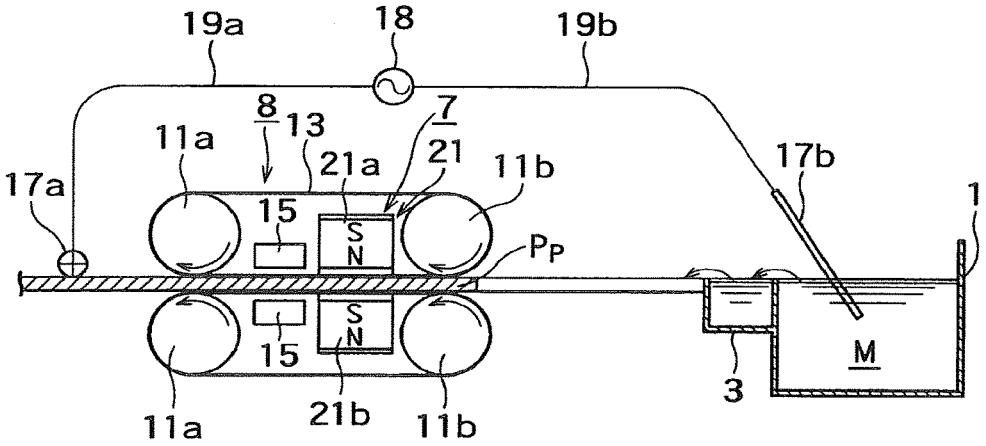
FIG. 2 is a schematic diagram illustrating main parts of an apparatus for manufacturing a conductive metal sheet according to a second embodiment of the invention.

FIG. 2 illustrates an apparatus for manufacturing a conductive metal sheet according to a second embodiment of the invention. This embodiment is different from the embodiment of FIG. 1 in that the magnetic field unit 21 is provided near the cooling device bodies 15. In this case, since the molten metal M having come out from the flow channel 5 has already passed through the rear pulleys 11*b* of the cooling device 8 and has been slightly cooled by the belts 13, the molten metal M present inside is modified in the same manner as described above even though the outside of the molten metal M is solidified and only the inside of the molten metal M is in the state of the molten metal M. Further, in this embodiment, the quality of the molten metal M is improved immediately before the molten metal M is solidified. For this reason, since high-quality molten metal M is solidified just as it is, a high-quality product can be obtained as a finished product P.

As known from the above description, according to each of the embodiments, the improvement of quality can be performed with high efficiency since the molten metal M or a pre-product Pp as a target is thin even though the intensity of a magnetic field generated from the magnetic field unit 21 is low and even though the current I flowing between the electrodes 17*a* and 17*b* is small. Furthermore, a conductive metal sheet (an aluminum sheet or the like) can be made from the molten metal M, which is present in the melting furnace, in a very short time.

The invention claimed is:

1. A method of manufacturing a conductive metal sheet, the method comprises cooling and solidifying molten conductive metal flowing out of a melting furnace by a cooling device to form a conductive metal sheet, cooling a raw material in which all of the conductive metal is in a molten state to make the raw material become a pre-product of which a part is solidified and the rest is in a molten state, and cooling further the pre-product to make the pre-product become the conductive metal sheet as a product in which all of the molten metal is solidified, the method comprising:

applying a magnetic field to the raw material or the pre-product in a thickness direction by a magnetic field unit including permanent magnets;

making alternating current flow at least between a front position and a rear position of a lengthwise direction of the magnetic field unit, and making the alternating current flow through at least one of the raw material and molten metal of the pre-product, so that the alternating current intersects the magnetic field; and applying vibration to at least one of the raw material and the molten metal of the pre-product by an electromagnetic force generated due to the intersection to modify the molten metal and form the conductive metal sheet in which all of the molten metal is solidified.

2. The method of manufacturing a conductive metal sheet according to claim 1, wherein a first electrode and a second electrode applying the alternating current are prepared, one of the first and second electrodes is electrically connected to the conductive metal sheet, and the other thereof is electrically connected to molten metal present in the melting furnace.

3. The method of manufacturing a conductive metal sheet according to claim 1, wherein a first electrode and a second electrode applying the alternating current are prepared, one of the first and second electrodes is electrically connected to the raw material or the pre-product on an outlet side of the magnetic field unit, and the other thereof is electrically connected to the raw material or the pre-product on an inlet side of the magnetic field unit.

4. The method of manufacturing a conductive metal sheet according to claim 1, wherein a magnetic field is applied to the raw material or the pre-product on a first half of the cooling device by the magnetic field unit.

5. The method of manufacturing a conductive metal sheet according to claim 1, wherein a magnetic field is applied to the raw material or the pre-product by the magnetic field unit while the molten conductive metal is cooled by the cooling device.

* * * * *